United States Patent [19]

Lamoureaux

[11] Patent Number: 5,025,936

[45] Date of Patent: Jun. 25, 1991

[54] RACK FOR STORING AND DISPLAYING BOTTLES

[76] Inventor: David Lamoureaux, P.O. Box 38, Arlington Heights, Ill. 60006

[21] Appl. No.: 428,990

[22] Filed: Oct. 30, 1989

[51] Int. Cl.[5] ..... A47B 73/00

[52] U.S. Cl. ..... 211/74; 248/152

[58] Field of Search ..... 211/74, 75, 72, 73, 211/194, 182; 248/152, 311.2, 311.3

[56] References Cited

U.S. PATENT DOCUMENTS

| | | | |
|---|---|---|---|
| 1,938,919 | 12/1933 | Marsh | 248/152 X |
| 3,480,152 | 11/1969 | Walsh | 211/74 |
| 3,746,179 | 7/1973 | Paumgardhen | 211/75 |
| 4,093,076 | 6/1978 | Newton | 211/74 |
| 4,422,555 | 12/1983 | Jacobs | 211/74 |
| 4,660,727 | 4/1987 | Levine | 211/74 |
| 4,700,849 | 10/1987 | Wagner | 211/74 X |

FOREIGN PATENT DOCUMENTS

| | | | |
|---|---|---|---|
| 0258155 | 3/1988 | European Pat. Off. | 211/74 |

*Primary Examiner*—David L. Talbott

*Assistant Examiner*—Daniel Hulseberg

*Attorney, Agent, or Firm*—Wood, Phillips, Mason, Recktenwald & Van Santen

[57] ABSTRACT

A rack for storing and displaying bottles of the type having a) a generally cylindrical body with a first diameter having an identifying label thereon and b) a generally cylindrical neck with a diameter less than the body diameter. The rack has first and second spaced walls with a first opening through the first wall with a diameter less than the diameter of the body of the bottle and a second opening through the second wall with a diameter greater than the diameter of the body of the bottle, and a third wall connecting the first and second walls so as to define a unitary structure with the first and second walls, with the unitary structure having a top, bottom, front and rear. Each bottle can be directed neck first through the second opening into the first opening to a display position, wherein the bottle is supported cooperatively by the first and second walls. The unitary structure is configured to be free standing on a subjacent surface in both an upright position and in an inverted position.

14 Claims, 2 Drawing Sheets

RACK FOR STORING AND DISPLAYING BOTTLES

BACKGROUND OF THE INVENTION

1. Field of the Invention

This invention relates to bottle racks and, more particularly, to a rack for storing a plurality of bottles which can be displayed selectively in different positions.

2. Background Art

It is common to construct bottle racks, such as wine racks, to accommodate the largest number of bottles that one anticipates storing and/or displaying. Exemplary prior art structures are shown in U.S. Pat. Nos. 273,647 232,284, 3,746,179, 3,870,156, 4,327,836, and British Patent Application GB 2 141 921.

The above structures nave several disadvantages. First of all, they are quite large and obtrusive. The structure shown in British Patent Application GB 2 141 921, while quite ornate and eye-catching, diverts one's attention from the displayed bottles, which is undesirable if one is attempting to show off a bottle, such as a prize bottle of wine, or the like.

Further, the racks which accommodate large number of bottles are rarely filled to capacity. The result is that the overall structure looks out of balance and may be rather unsightly.

A further problem with the above structures is that they are generally one-dimensional. For example, the wine rack shown in U.S. Pat. No. 232,284 has practical utility only when suspended from a vertical wall.

Another problem with prior art bottle racks is that they are generally quite complicated to construct. For example, the wine rack in U.S. Pat. No. 232,284 requires fairly complex forming steps, which adds considerably to the cost of manufacture. If different diameter bottles are to be accommodated, the forming process must be significantly altered.

Still further, wine racks, such as that in U.S. Pat. No. 232,284, are relatively difficult to keep clean. There are numerous nooks and crannies in which foreign matter can accumulate and which are inaccessible to one cleaning the rack.

A further problem with the prior art structures, particularly ones such as that in U.S. Pat. No. 232,284, is that often the bottles are precariously situated when in the display position on the rack. A simple shifting of the bottles may cause the bottles to fall off and break. This obviously is an inadequate structure for displaying expensive wines and the like.

SUMMARY OF THE INVENTION

The present invention is specifically directed to overcoming the above-enumerated problems in a novel and simple manner.

According to the invention, a rack is provided for storing and displaying bottles of the type having a) a generally cylindrical body with a first diameter having an identifying label thereon and b) a generally cylindrical neck with a diameter less than the body diameter. The rack has first and second spaced walls with a first opening through the first wall with a diameter less than the diameter of the body of the bottle and a second opening through the second wall with a diameter greater than the diameter of the body of the bottle, and a third wall connecting the first and second walls so as to define a unitary structure with the first and second walls, with the unitary structure having a top, bottom, front and rear. Each bottle can be directed neck first through the second opening into the first opening to a display position, wherein the bottle is supported cooperatively by the first and second walls. The unitary structure is configured to be free standing on a subjacent surface in both an upright position and in an inverted position.

In each of the upright and inverted positions, the bottle in the display position is horizontally oriented so that the identifying label thereon is visible between the first and second walls. The bottles are securely maintained in their display positions. Further, in the case of wines being displayed, the cork is maintained in a moistened state by reason of its orientation.

The present invention has as its principal objective the provision of a compact bottle rack that is simple and economical to construct, yet one which is extremely versatile in its display function, both in terms of capacity and number of potential display orientations.

In its simplest state, the unitary structure consists of first and second walls interconnected so as to define a generally V-shape. The top and bottom edges of the first and second walls cooperatively support the rack selectively in free standing upright and inverted positions.

In a preferred form, the first and second walls have front edges which permit supporting of the unitary structure thereon in a face down display position.

Preferably, the rack is a single sheet of clear plastic, which can be formed to the desired configuration. Alternatively, the rack can be formed by injection molding. The clear plastic produces an aesthetically pleasing appearance, yet one which does not divert attention from the bottle supported by the rack. With the rack being clear, the bottle supported thereon can be viewed effectively from virtually an unlimited number of angles. The rack will fit in with almost any decor. The plastic material can also be subjected to a cold environment, such as in a refrigerator, without damage thereto.

In another form of the invention, there is a third, flat wall interconnecting the first and second walls, which may be at right angles to the third wall or otherwise angled with respect thereto. The third wall serves a variety of different functions. The third wall facilitates mounting of the rack on the underside of a horizontal shelf, such as in a refrigerator, or from a vertical support surface for the rack, in each case through the use of anchors. In the former position, the third wall shields the bottles, which are supported on the rack, to thereby maintain the clean appearance of the bottles. The third wall can also be used to support the rack on an upwardly facing horizontal surface.

The inventive rack can be readily cleaned. The walls have relatively flat, and preferably smooth, surfaces which can be easily wiped clean with a cloth. There are no inaccessible crevices in which dirt buildup can occur.

The rack, according to the present invention, is extremely versatile in terms of not only the size of the bottles it can hold but also in terms of capacity. To accommodate different size bottles, it is only necessary to vary the size of the openings in each of the first and second walls.

The invention contemplates a basic structure with the capacity to store a relatively small number of bottles—preferably three, so that it is of a manageable size. If it is desired to increase the storage capacity, the units can be stacked, one upon the other. In a preferred form, H-clips are employed to facilitate vertical stacking of the units. With the H-clips, the units can be readily stacked and unstacked in the event that the increased capacity is no longer necessary.

A further advantage of the present invention is that it can be stored in any of a variety of different positions on a subjacent support surface without any anchoring. That is, the device is free standing in upright, inverted, face up and face down positions for certain configurations thereof.

To accommodate different bottle sizes, one need only vary the size of the holes in the walls. Bottles as small as those used in cooking and as large as champagne bottles can be easily accommodated. Further the hole positions can be easily varied to change the bottle display angle.

DETAILED DESCRIPTION OF THE DRAWINGS

Figure 2:
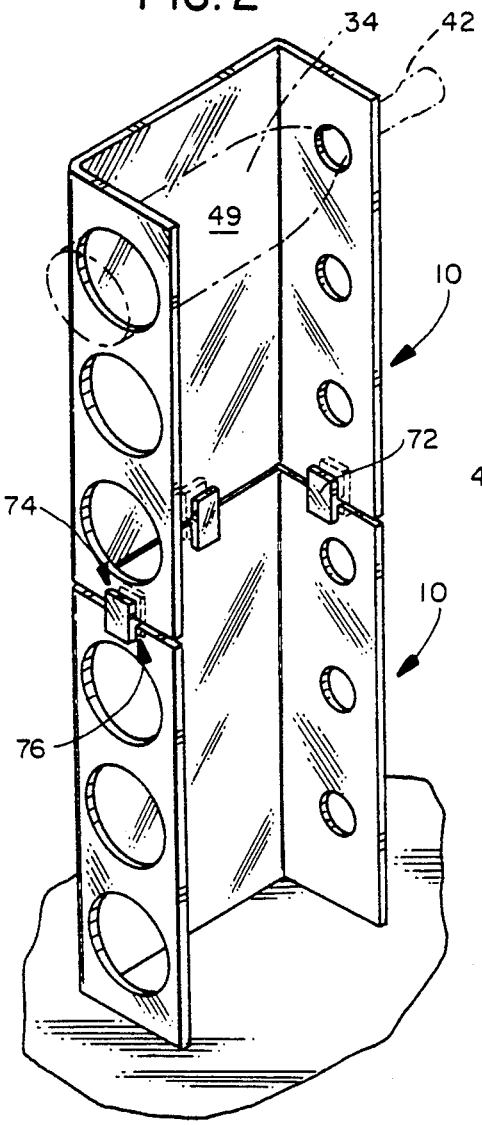
FIG. 2 is a front perspective view of two racks, such as that in FIG. 1, stacked in vertical relationship to increase bottle storage/display capacity.

In FIGS. 1–6, a first form of bottle rack, according to the present invention, is shown at 10. The rack 10 consists of a first, generally rectangular wall 12, a second wall 14, configured similarly to the first wall 12, and a rectangular third wall 16 connecting the first and second walls 12, 14 to define a generally U-shaped, unitary structure.

The first wall 12 has a bottom supporting edge 18, a top supporting edge 20, and a front supporting edge 22. The second wall 14 has a like bottom supporting edge 24, top supporting edge 26 and a front supporting edge 28. The third wall 16 has a bottom supporting edge 30 and a top supporting edge 32.

The rack 10 is designed to store/display three bottles configured such as the bottle 34 in FIG. 2. To support the bottle 34, three equidistantly spaced openings 36, 38, 40 are provided through the first wall 12 to accept the bottle neck 42. The second wall 14 is provided with a corresponding number of coaxially aligned openings 44, 46, 48 of a diameter large enough to accept the cylindrical body 49 of the bottle 34. The bottle 34 is directed, neck first, through any of the openings 44, 46, 48 in the second wall 14 and into the openings 36, 38, 40 in the first wall 12. The bottle 34 is thereby positively held in position on the rack 10 and can be removed only by moving the bottle 34 oppositely to the way it was inserted into the rack 10. The body 49 of the bottle 34 abuts the wall 12 to limit left to right bottle movement.

Figure 1:
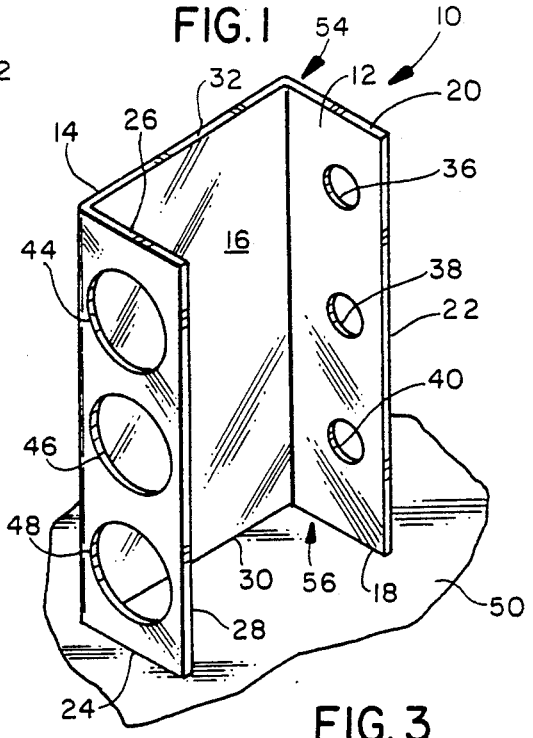
FIG. 1 is a front perspective view of a preferred form of bottle rack, according to the present invention, in a free standing upright position on a subjacent support surface.

In FIG. 1, the rack 10 is shown in a free standing, upright position, wherein coplanar edges 18, 24, 30 cooperatively support the rack 10 on a flat, upwardly facing, subjacent support surface 50. In that position, the label 52 on the bottle 34 is readily visible between the walls 12, 14.

The diameter of the openings 36, 38, 40, 44, 46, 48 is dictated by the configuration of the bottle 34. By simply varying the opening diameter, various different types of bottles can be accommodated. Similarly, the width of wall 16 is chosen depending on the type of bottle that is to be stored/displayed. The location of openings 36, 38, 40, 44, 46, 48 can also be varied to change the angle of the displayed bottle 34 from horizontal.

In a preferred form, the entire rack 10 is formed from plastic, that is preferably clear. Consequently, one can view the displayed bottle 34 from virtually any angle. The formation may be either by bending a blank of plastic sheet material or by injection molding. In either event, the resulting rack 10 is simply manufactured and is smooth and streamlined so that cleaning thereof is facilitated.

The top rack edges 20, 26, 32 are coplanar and allow the rack 10 to be situated in an inverted, free standing position on the surface 50. Consequently, the user has the option of displaying bottles 34 from right to left and from left to right, depending upon whether the rack is in an upright or an inverted position. In either position, each bottle 34 is positively held in place on the rack 10.

Figure 3:
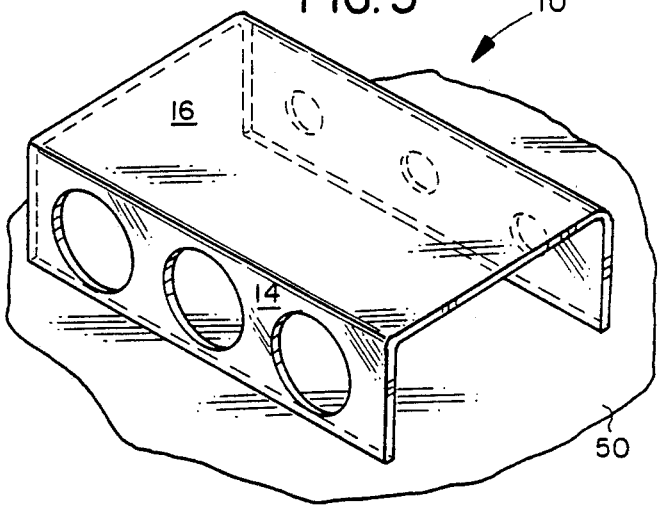
FIG. 3 is a perspective view of the bottle rack in FIG. 1 in a free standing face down display position.
Figure 5:
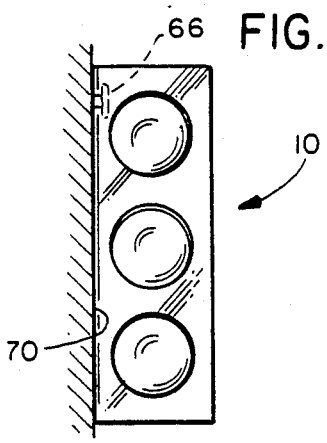
FIG. 5 is a side elevation view of the bottle rack in FIG. 1 anchored to a vertical support surface.
Figure 6:
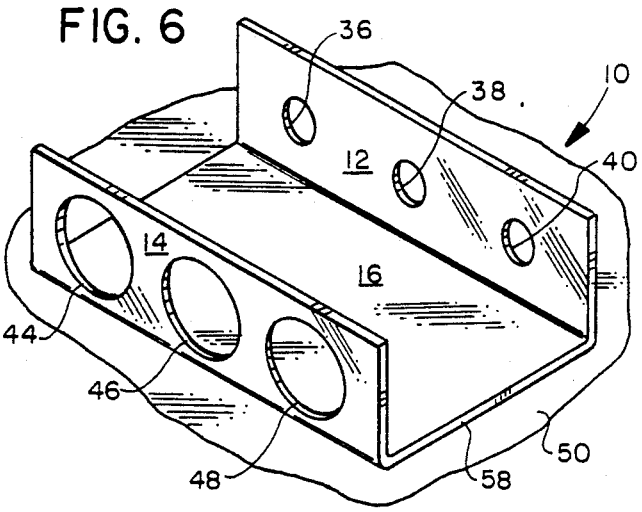
FIG. 6 is a perspective view of the bottle rack in FIG. 1 in a free standing, face up display position on a subjacent support surface.

The rack 10 can also be displayed face up, as in FIG. 6, or face down, as in FIG. 3. In the face down position of FIG. 3, the front edges 22, 28 of the first wall 12 and second wall 14, respectively, cooperatively support the rack 10 on the surface 50. Because the third wall 16 is clear, the bottles 34 displayed on the rack 10 in the face down position of FIG. 5 can be readily viewed through the wall 16. The wall 16, which is preferably continuous and uninterrupted between the first and second walls 10, 12 and the top 54 and bottom 56 of the rack 10, shields over half of the height of the bottles 34 displayed therein in the FIG. 5 position. This is a desirable feature when the rack 10 is used in a refrigerator, wherein liquids and foods might be spilled on the rack 10.

Figure 4:
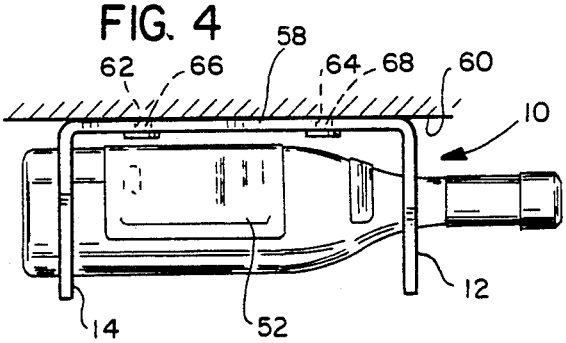
FIG. 4 is a front elevation view of the bottle rack in FIG. 1 anchored to a downwardly facing support surface.

In the face up position of FIG. 6, the rear planar surface 58 on wall 16 facially abuts the support surface 50. The planar surface 58 on the third wall 16 can also be utilized to mount the rack 10 from a downwardly facing, horizontal surface 60, as shown in FIG. 4. Bores 62, 64 can be provided through the wall 16 to accept suitable, conventional anchors 66, 68, respectively. The anchors 66, 68 can also be utilized to mount the rack 10 to a vertically extending, flat surface 70, as shown in FIG. 5.

The invention also contemplates stacking of individual racks 10 to increase storage capacity. FIG. 2 shows two like racks 10 stacked vertically to double the capacity from three to six bottles. To hold the racks 10 together, a plurality of H-shaped clips 72 are utilized, and in the embodiment shown, three clips 72 are used. Each clip 72 has an upwardly opening channel 74 and a downwardly opening channel 76. The downwardly opening channels receive the upper edges 20, 26, 32 of the first, second and third walls, respectively, on an underlying rack 10, while the upwardly opening channels 74 receive the downwardly facing edges 18, 24, 30 on the first, second and third walls, respectively, of an overlying rack 10. The clips 72 can be put in place on the underlying rack 10 whereafter the overlying rack 10 can be nested in the clip channels 74. Preferably, the clips 72 only frictionally grip the racks 10 so that disassembly is facilitated. It is, however, also within the scope of the invention to anchor the clips 72 to one or both of the racks 10.

Figure 7:
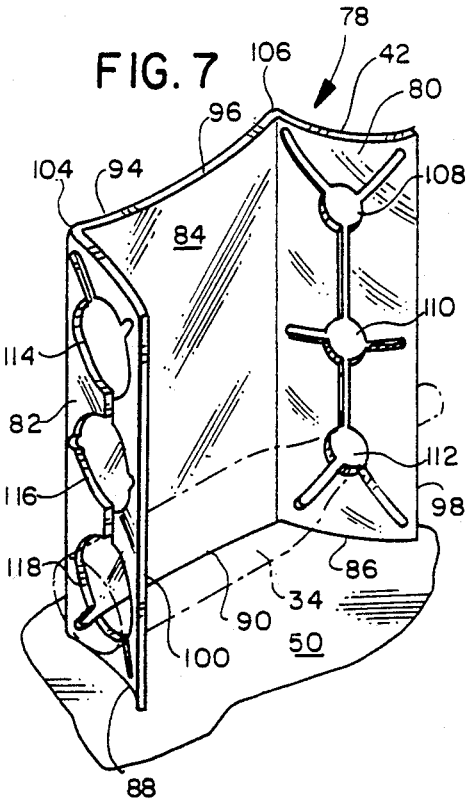
FIG. 7 is a perspective view of a modified form of the bottle rack, according to the present invention, in a free standing position on a subjacent support surface.
Figure 8:
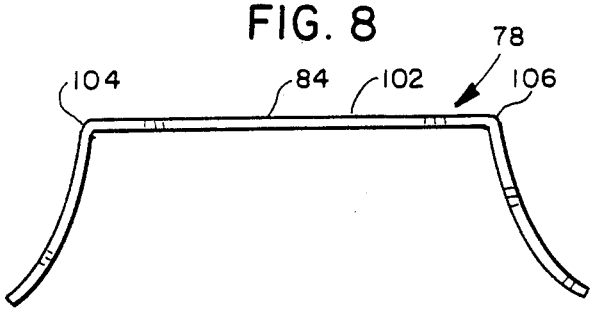
FIG. 8 is a plan view of the bottle rack of FIG. 7.

The invention contemplates configurations other than that for the rack 10 shown in FIGS. 1–6. In FIGS. 7 and 8, a rack 78, with a modified configuration, is shown. The rack 78 has corresponding first, second and third walls 80, 82, 84, consecutively. The third wall 84 can have a bowed configuration, as in FIG. 7, or a flat configuration as in FIG. 8. In either event, the rack 78 functions in substantially the same manner as the rack 10 in FIGS. 1–6. That is, the rack 78 can be supported in a free standing upright position on a subjacent support 50 on coplanar edges 86, 88, 90, in an inverted position on edges 92, 94, 96, and in a face down position on edges 98, 100.

If the wall 84 has the flat configuration of FIG. 8, the planar rear surface 102 thereon can be placed facially against the flat support 50 in a face up position. In the FIG. 7 configuration, spaced edges 104, 106 cooperatively support the rack 78 in the face up position.

The FIG. 7 configuration for the rack 78 has interconnected openings 108, 110, 112 on the first wall 80 and interconnected openings 114, 116, 118 on the second wall 82, which openings accommodate the bottles 34 in the same manner as the previously described embodiment.

Figure 9:
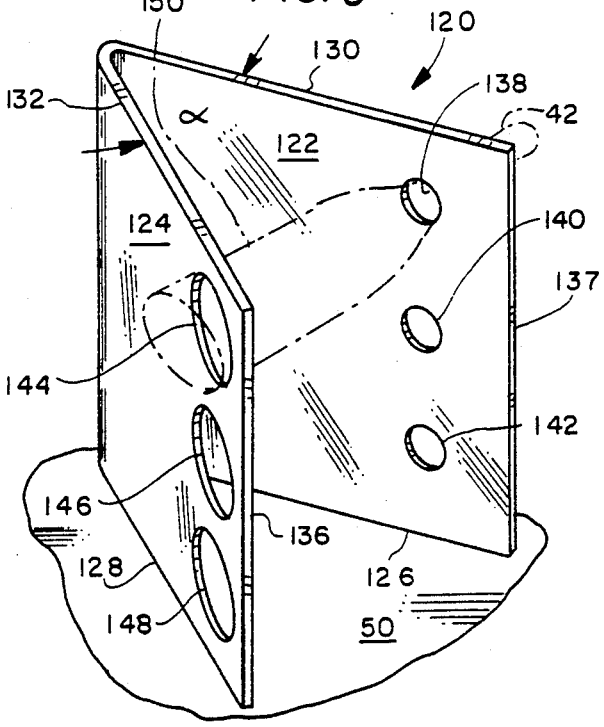
FIG. 9 is a perspective view of a still further modified form of bottle rack, according to the present invention, in a free standing upright position on a subjacent support surface.

The invention is shown in its simplest state at 120 in FIG. 9. The rack 120 consists of a first wall 122 and a second wall 124, folded relative to each other so as to define a V-shape with an included angle $\alpha$ that is less than 90°. In an upright position, the rack 120 is supported on wall edges 126, 128 and in an inverted position on edges 130, 132. In a face down position, the front edges 134, 136 cooperatively support the rack 120 on the subjacent surface 50.

The wall 122 has openings 13B, 140, 142 to accept the bottle neck 42 and the wall 124 has coaxial openings 144, 146, 148 therethrough to accept the cylindrical body 49 of the bottle 34.

In all of the above described embodiments, each of the wall openings for the bottles 34 is entirely enclosed by the wall through which it is provided. Accordingly, it is only possible to release the bottle 34 from its storage/display position by reversing the direction of insertion i.e. by sideward movement. Thus, the bottles 34 are securely held in place.

While the racks 10, 78, 120 are preferably made from clear plastic, the invention also contemplates fabrication from wood, metal, glass, plastic, clay, aluminum, and many other different materials.

The foregoing disclosure of specific embodiments is intended to be illustrative of the broad concepts comprehended by the invention.

I claim:

1. A rack for storing and displaying bottles of the type having a) a generally cylindrical body with a first diameter and an identifying label thereon and b) a generally cylindrical neck with a diameter less than the body diameter, said rack comprising:

first and second spaced walls, there being a first opening through the first wall with a diameter less than the diameter of the body of the bottle and a second opening through the second wall with a diameter greater than the diameter of the body of the bottle;

a third wall connecting the first and second walls so as to define a unitary structure with said first and second walls, said unitary structure having a top, bottom, front and rear;

means on the bottom of the unitary structure for supporting the unitary structure in a free standing upright position on a horizontal subjacent support surface, said bottom supporting means comprising a continuous first edge on the first, second and third walls that resides in a first plane;

whereby with said unitary structure in an upright position on said first edge, a bottle can be directed neck first through the second opening and into the first opening to a display position so that the bottom is supported cooperatively by the first and second walls in a substantially horizontal position wherein at least part of the body of the bottle and the identifying label thereon is visible between said first and second walls from the front of the unitary structure; and means on the top of the unitary structure for supporting the unitary structure in a free standing inverted position on a horizontal subjacent support surface, said top supporting means comprising a continuous second edge on the first, second, and third walls that resides in a second plane, whereby with a bottle in the display position and the unitary structure in the inverted position on said second edge, the bottom is in a substantially horizontal position, said third wall being translucent, extending substantially continuously and uninterruptedly between the first and second walls and the first and second planes and defining a planar rear surface on which the rack can be supported, said first, second and third walls having a one-piece construction, whereby bottles on the rack can be displayed selectively in any of three different positions.

2. The bottle rack of claim 1 wherein means are provided on the front of said unitary structure for supporting the unitary structure in a face down position on a horizontal subjacent support surface in which a bottle in the display position is substantially horizontally situated.

3. The bottle rack of claim 1 wherein said unitary structure is made from a clear material.

4. The bottle rack of claim 1 wherein said unitary structure is formed from a single clear sheet of plastic.

5. The bottle rack of claim 1 wherein the unitary structure is formed by injection molding.

6. The bottle rack of claim 1 wherein there are a plurality of first openings in said first wall and a like plurality of second openings in the second wall to accommodate a plurality of bottles.

7. The bottle rack of claim 1 including means for connecting said bottle rack to a like bottle rack to increase bottle storage capacity.

8. The bottle rack of claim 6 wherein there are three and only three of said first openings in said first wall and three and only three of said second openings in said second wall 9. The bottle rack of claim 7 wherein said connecting means comprises means for releasably connecting said bottle racks.

10. The wine bottle rack of claim 1 wherein at least one of said first and second walls has a curved configuration.

11. The wine bottle rack of claim 1 wherein there are a plurality of openings in each of said first and second walls and at least one of said first and second walls is cut out so that a plurality of openings therein are interconnected.

12. The wine bottle rack of claim 1 wherein the unitary structure has an overall U-shape.

13. The wine bottle rack of claim 2 wherein the supporting means on the front of the rack comprises co-planar edges and the first and second walls reside in a plane that is perpendicular to both said first and second planes.

14. The wine bottle rack of claim 1 wherein means are provided on the third wall for mounting the planar surface of the third wall facially against a vertically extending flat surface.

* * * * *